United States Patent [19]

Wright et al.

[11] Patent Number: 5,012,706

[45] **Date of Patent: * May 7, 1991**

[54] SOCKET WRENCH OPENING

[75] Inventors: Richard B. Wright, Akron; Theodore M. Vozenilek, Canton; Brent P. Fleming, Copley, all of Ohio

[73] Assignee: Wright Tool Company, Barberton, Ohio

[ * ] Notice: The portion of the term of this patent subsequent to Nov. 28, 2006 has been disclaimed.

[21] Appl. No.: 429,761

[22] Filed: Oct. 31, 1989

Related U.S. Application Data

[63] Continuation-in-part of Ser. No. 286,604, Dec. 16, 1988, Pat. No. 4,882,957.

[51] Int. Cl.[5] ..... B25B 13/06

[52] U.S. Cl. ..... 81/121.1

[58] Field of Search ..... 81/119, 121.1, 186

[56] References Cited

U.S. PATENT DOCUMENTS

| | | |
|---|---|---|
| 2,777,353 | 1/1957 | Willis . |
| 3,079,819 | 3/1963 | Wing . |
| 3,125,910 | 3/1964 | Kavalar . |
| 3,242,775 | 3/1966 | Hinkle . |
| 3,273,430 | 9/1966 | Knudsen et al. . |
| 3,354,757 | 11/1967 | Grimm et al. . |
| 3,466,956 | 9/1969 | Bowers . |
| 3,495,485 | 2/1970 | Knudson et al. . |
| 3,675,516 | 7/1972 | Knudsen et al. . |
| 3,885,480 | 5/1975 | Muenchinger . |
| 3,903,764 | 9/1975 | Andersen . |
| 3,908,488 | 9/1975 | Andersen . |
| 4,010,670 | 3/1977 | Lejdegard . |
| 4,100,824 | 7/1978 | Marschke . |
| 4,361,412 | 11/1982 | Stolarczyk . |
| 4,512,220 | 4/1985 | Barnhill et al. . |
| 4,581,957 | 4/1986 | Dossier . |
| 4,598,616 | 7/1986 | Colvin . |

FOREIGN PATENT DOCUMENTS

| | | |
|---|---|---|
| 602687 | 3/1960 | Italy . |

*Primary Examiner*—James G. Smith

*Attorney, Agent, or Firm*—D. Peter Hochberg; Mark Kusner; Louis J. Weisz

[57] ABSTRACT

A wrench for turning a fastener nut having a central axis and an even-numbered plurality of flat bounding surfaces parallel to the central axis with diametrically opposite pairs being parallel to each other. The wrench includes a fastener nut engaging socket defined about a central socket axis by a plurality of uniformly spaced peripherally and radially disposed protuberances and plurality of uniformly spaced corner recesses disposed between the protuberances. Each protuberance includes outwardly diverging angularly related straight engaging surfaces for registry with the flat surfaces on the fastener nut. Each recess is comprised of a first arcuate surface tangential to a circle about the central axis of the socket and transitional surfaces converging from the adjacent protuberances toward the first arcuate surface.

8 Claims, 4 Drawing Sheets

SOCKET WRENCH OPENING

This is a continuation-in-part of copending application Ser. No. 286,604, filed on Dec. 16, 1988, now U.S. Pat. No. 4,882,957.

FIELD OF THE INVENTION

The present invention relates generally to rotary tools for driving a hexagonal and/or double hexagonal threaded fastener, and more particularly to wrench socket openings having driving surfaces which improve the internal stressed distributions of the socket.

BACKGROUND OF THE INVENTION

The present invention relates to improvements in wrench socket designs which redistribute and reduce the internal stresses exerted on the socket during driving and which improve the driving performance of the socket by providing a driving surface at an angle which best matches the fastener face to be driven.

When designing socket wrench openings, to avoid breakage of the wrench and/or deformation of the fastener, it is desirable to minimize the stress exerted on the socket. It is likewise desirable to distribute, as uniformly as possible, the stress exerted on the socket. Stress analysis indicates that three important points of high stress exist when a socket wrench engages the flank or face of a hexagonal or double hexagonal fastener. The first area of stress is where the wrench driving surface meets the fastener face. It is desirable that this surface be as large as possible to more uniformly distribute the stress throughout the socket. It is also important that the drive surface be, as nearly as possible, parallel to the fastener face to minimize peak stress. This is achieved by orienting the drive surface at an angle which takes into account the position of the wrench when it engages the fastener. In this respect, a small clearance exists between the internal socket surface and the fastener to be driven. As this clearance is taken up in turning the wrench to engage the fastener, the wrench is angularly displaced relative to the fastener. Thus, there is a need to choose an angle for the wrench driving surfaces of the socket which best matches that of the fastener when the wrench is in the angularly displaced position.

The second important area of stress concentration is at the outer edge where the driving surface of the socket wrench ceases to contact the fastener, i.e. at the corner of the fastener. Because there is an abrupt contact pressure area at the corner of the fastener which results in an abrupt stress peak, it is desirable that the driving surface not contact the fastener at the corner thereof.

The third area of stress concentration is the portion of the wrench socket adapted to receive the corner of the fastener. In conventional wrench design, this area is a sharp arcuate angle which acts to concentrate the stress exerted on the socket.

The present invention provides socket wrench openings which maximize the drive face, avoid contact with the corner of the fastener, and eliminate sharp angels, i.e. corners, and further provides wrench socket opening shapes which lend themselves to efficient, reproducible, and economical manufacture.

SUMMARY OF THE INVENTION

In accordance with one embodiment of the present invention there is provided a wrench for turning a fastener nut having a central axis and an even numbed plurality of flat bounding surfaces parallel to the fastener access wherein diametrically opposite pairs of surfaces are parallel to each other and the bounding surfaces intersect in adjacent pairs to form fastener corners. The wrench includes a fastener nut socket defined by a central socket axis. The socket includes a plurality of uniformly spaced peripherally and radially disposed protuberances and a plurality of uniformly spaced fastener corner clearance recesses disposed between protuberances. Each protuberance includes side by side, angularly related straight engaging surfaces at substantially 142 degrees outside obtuse angle to each other for registry with the flat surfaces on the fastener nut. Complimentary side surfaces diverge outwardly from the engagement surfaces. Each engaging surface has a length substantially equal to 0.0867 x the minor diameter of the fastener nut to be driven and the side surfaces diverge at least 3 degrees outwardly from the engaging surfaces. Each corner clearance recess is comprised of a first arcuate surface defined about the central axis of the socket and transition surfaces converging from the side surfaces of the adjacent protuberances outwardly toward the arcuate surface.

More specifically, the engaging surfaces of the socket opening are dimensioned to provide a larger driving surface and are oriented to position these surfaces generally parallel to the flat surfaces of the fasteners during driving engagement. This provides a more uniform distribution of the stress exerted on the socket. Likewise, the side surfaces, which diverge from the driving surfaces, are positioned such that the engaging surfaces of the socket avoid contact with the corner of the fastener. This eliminates any large stress peaks in the engaging surfaces. With respect to the corner recesses of the socket, the arcuate surface and the transition surfaces are dimensioned to provide an approximate rounded area which blends with the other wrenching surfaces. This avoids large stress concentration found in sockets having corner clearance recesses defined by shape arcuate angles.

In accordance with another embodiment of the present invention, there is provide a wrench for turning a fastener nut having a central axis and an even-numbered plurality of flat bounding surfaces parallel to the fastener axis wherein diametrically opposite pairs of surfaces are parallel to each other and the bounding surfaces intersect in adjacent pairs to form fastener corners. The wrench includes a fastener nut socket defined by a central socket axis. This socket includes a plurality of uniformly spaced peripherally and radially disposed protuberances and a plurality of uniformly spaced fastener corner clearance recesses disposed between the protuberances. Each protuberance is comprised of three drive surfaces, namely a straight connecting surface with complimentary straight engaging surfaces diverging outwardly from the connecting surface, said engaging surfaces being at substantially a 176° (degree) outside obtuse angle to each other for registry with the flat surfaces on the fastener nut. Each connecting surface has a length substantially equal to 0.21256 x the mean flats of the fastener nut to be driven with the engaging surfaces diverging at least 2°, (degrees) outwardly from the connecting surface. Each corner clearance recess is comprised of a first arcuate surface defined about the central axis of the socket and transition surfaces converging from the engaging surfaces of the adjacent protuberances outwardly toward the arcuate surface.

This embodiment of the present invention has the advantage of providing a wrench opening with a slightly greater across corners dimension than standard hexagonal openings, thus providing space to eliminate the normal shape corner on the socket and reducing stress concentrations normally located in the corners. With respect to the corner recesses of the socket, the arcuate surface and the transition surfaces are dimensioned to provide an approximate rounded area which blends with the other wrenching surfaces. This avoids large stress concentrations found in sockets having corner clearance recesses defined by sharp arcuate angles.

Importantly, by defining these socket openings with mostly flat surfaces (the exception being the arcuate surface of the recess), it is easier to manufacture the forging punches which form the socket openings. In this respect, the disclosed socket designs avoid "steps" or imperfections generally found in designs which attempt to include curved surfaces which intersect with each other, in that forging punches must be machined one tooth at a time by cutting tools which produce lines of intersection between each machining pass. This generally results in lines or ridges in designs having mating surfaces which are curved. In other words, designs which appear very smooth when drawn or drafted, are actually very difficult to manufacture. The present invention thus provides a plurality of flat surfaces, which provide a profile which is easier to machine, yet which at the same time avoids sharp corners and stress peaks.

Also important with respect to the present invention is that the claimed socket openings permit longer forging punch life. In this resect, in the practical business of making socket wrench openings, industry standards set certain tolerances which must be met and which effect the manufacture of the sockets. Generally socket openings are tested with gauges which establish the maximum and minimum opening sizes. In the art, it is generally well known that the corners of the forging punches generally wear faster than the flat engaging surfaces of the punch. It has been known to use as large a punch as possible so as to give a reasonable amount of wear on the corners before they become undersized. This results in the across flats dimension being on the large size if the punch is a hexagon design because the across the flats dimension is fixedly linked to the across the corners dimension of the punch. The present invention enables a punch having a reduced across the flat dimension wherein the initial size of the punch can be dimensioned to lie in the midsize of the gauging range. As set forth above, the included angles of the driving surfaces of the wrench are oriented to compensate for the rotation that occurs between the wrench and fastener in the process of engagement. The angles are chosen so as to produce close to parallel engagement between the engaging surfaces of the sockets and the flat portion of the fastener over the range of acceptable fastener sizes. Thus, in addition to providing socket openings which reduce and distribute more evenly the internal stress exerted on the sockets during driving, the present designs facilitate reproduction of the sockets, as well as extend forging punch life.

It is an object of the present invention to provide multi-sided drives for hexagonal and/or double hexagonal fasteners having drive surfaces which are substantially parallel to the surface flats of the fasteners during driving.

It is another object of the present invention to provide multi-sided drives as described above which eliminate sharp arcuate angles in the fastener corner clearance recesses.

It is another object of the present invention to provide multi-sided drives as described above which reduce and more uniformly distribute the internal stress that is exerted on the socket during driving.

Another object of the present invention is to provide multi-sided drives as described above having shapes which lend themselves to efficient reproduction and which facilitates longer forging punch life.

These and other objects and advantages will become apparent from the following description of preferred embodiments of the invention taken together with the accompanying drawings.

DRAWINGS

The invention may take physical form in certain parts and arrangement of parts, embodiments of which are described in detail in the specification and illustrated in the accompanying drawings wherein:

FIG. 6 is an enlarged plan view of another embodiment of the present invention;

FIG. 7 is an enlarged view showing the typical surface contact between the connecting surface of the socket shown in FIG. 6 and the flat portion of a hexagonal fastener; and, FIG. 8 is an enlarged view of area 8—8 of FIG. 6 illustrating a typical protuberance and corner recess of the socket shown in FIG. 6.

DETAILED DESCRIPTION OF THE PREFERRED EMBODIMENTS

Figure 1:
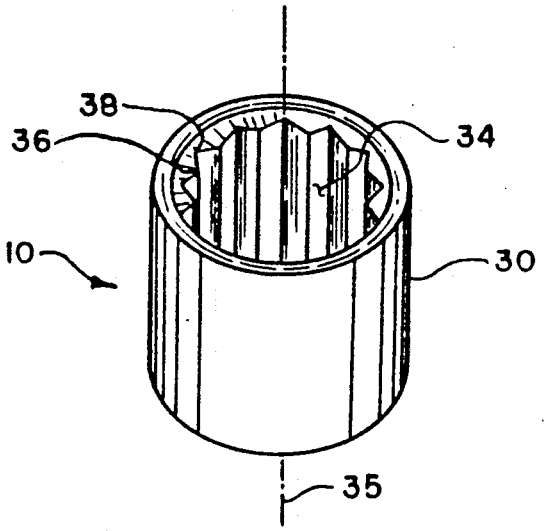
FIG. 1 is a perspective view of a socket wrench illustrating the shape of one embodiment of the present invention.

Referring now to the drawings wherein the showings are for the purpose of illustrating several embodiments of the present invention and not for purpose of limiting same, FIG. 1 shows a wrench socket for turning a polygonally shaped element such as a conventionally known hexagonal or double hexagonal threaded fastener. For the purpose of illustration, a hexagonal fastener 20 is shown in phantom in FIG. 2. Fastener 20 includes a number of planar faces 22 which are generally parallel and equidistant from a central axis 24. Faces or flanks 22 intersect at dihedral angles to form corners 26. The illustrated fastener 20 is considered as having standard dimensions for any given size and is within the maximum-minimum standard across opposed faces 22—22.

Figure 2:
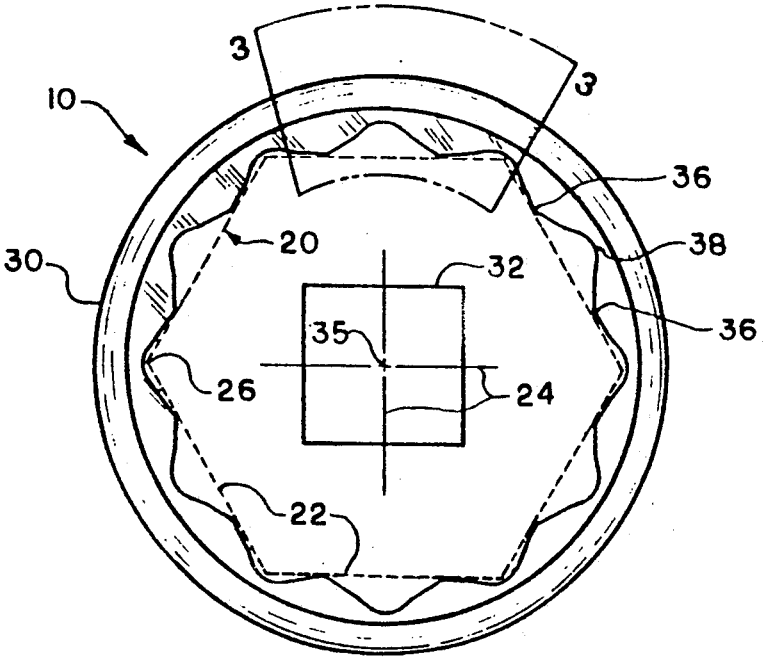
FIG. 2 is an enlarged view of the socket shown in FIG. 1.

The socket wrench 10 is comprised of a generally cylindrical body 30 which is provided at one end with a substantially square socket 32 (best seen in FIG. 2) for reception of the operating stem of a suitable socket wrench, a motor driven spindle or other actuating member (not shown). The other end of body 30 is provided with a work receiving cavity 34 which is symmetrical about an axis 35, which in FIG. 2 is coincident with axis 24 of fastener 20. Cavity 34 is comprised of an even-numbered plurality of uniformly spaced peripherally and radially disposed protuberances 36 having an equal number of nut corner clearance recess 38 disposed therebetween. (As used hereinafter, inward or inner shall designate a direction toward the central axis 35 of socket 10, and outward or outer shall designate a direction away from axis 35.)

Figure 3:
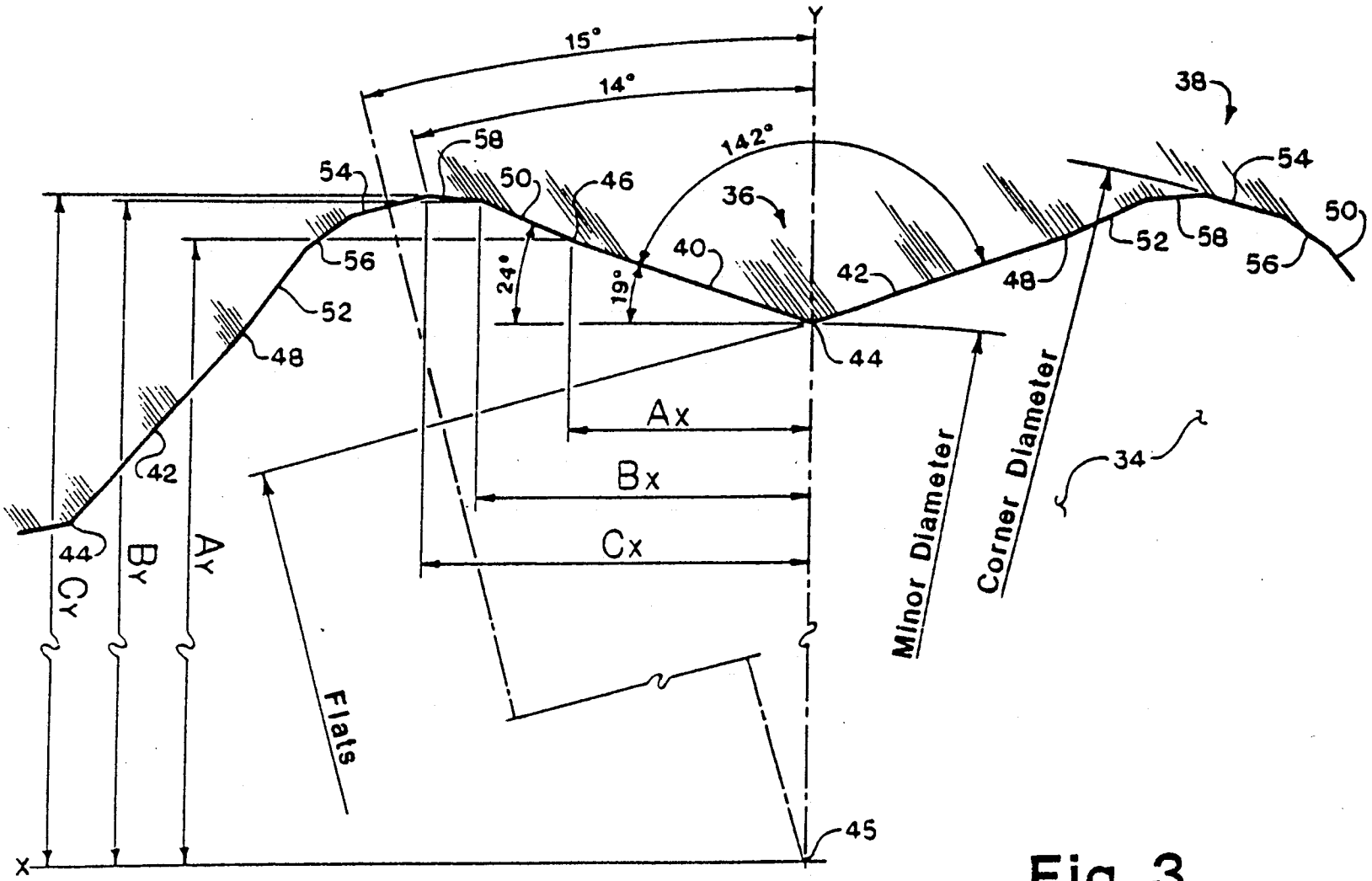
FIG. 3 is an enlarged view of area 3—3 of FIG. 2 illustrating a typical protuberance and corner recess of the socket shown in FIG. 1.

In this embodiment, socket 10 includes twelve (12) protuberances 36 and twelve (12) corner recesses 38. In FIG. 3 an enlarged portion of a socket according to the present invention is shown in relation to axes designated "X" and "Y" which are normal to each other and intersect at the central axis 45 of the socket. Each protuberance 36 includes side by side nut engagement or driving surfaces 40, 42 which diverge outwardly from a point 44. Driving surfaces 40, 421 are disposed at substantially 142° (degrees) outside obtuse angles to each other for registry with the planar faces or flanks 22 of fastener 20. Engagement surfaces 40, 42 have identical predetermined lengths which terminate at edges 46, 48 respectively. Complimentary side surfaces 50, 42 diverge outwardly away from surfaces 40, 42 at edges 46, 48. In the embodiment shown, side surface 50, 52 diverge away from engagement surfaces 40, 42 respectively at a 5° (degree) angle.

Nut corner clearance recesses 38 are comprised of an arcuate surface 54, and transitional surfaces 56, 58 which diverge from arcuate surface 54 and intersect with complimentary side surfaces 50, 52 of adjacent protuberances 36. Arcuate surface 54 is defined by a circle about socket axis 45. Preferably, arcuate surface 54 and transitional surface 56, 58 approximate a circular arc connecting diverging surfaces 40, 42 of adjacent protuberances 32. To minimize stress concentrations at the corners defined by the respective surfaces, it is also preferable that the angle defined between arcuate surface 54 and an adjacent transitional surface 56, 58 be approximately equal to the angle defined between a transitional surface 56, 58 and a diverging surface 50, 52. In this respect, by equalizing these angles, the stress concentrations resulting from such corners are minimized and distributed, to the extent possible, along the entire corner recess 38.

This embodiment of the present invention provides a corner recess design which is easy to manufacture, yet approximates the optimum design of a fully rounded corner. In this respect, a truly rounded corner recess is not actually possible due to manufacturing limitations in creating the forging punches used to manufacture the sockets. Cutting machines which cut the forging punch make a number of successive passes along the punch cutting flat surfaces which together approximate a curve. Such cutting machines inevitably leave "steps" between the successive passes. In this embodiment of the present invention, because socket cavity 34 is comprised essentially of flat surfaces, greater dimensional accuracy is provided when manufacturing the forging punches used to form the socket opening 34. As will be appreciated, arcuate surface 54, which is disposed on the periphery of a forging punch, may be machined by a lathe thereby ensuring dimensional accuracy.

The length and orientation of the planar surfaces defining socket cavity 34 is determined by the size of the fastener nut 20 to be turned as well as certain design criteria. In this respect, these planar surfaces are dimensioned to maximize the driving surfaces 40, 42 to avoid contact with the corners 26 of fastener 20; to minimize stress concentrations by avoiding sharp arcuate angles such as at the corner recesses 38; to provide a more parallel engagement between driving surfaces 40, 42 and fastener faces 22. As shown in FIG. 3, the shape of the socket opening 34 may be defined with reference to X-Y coordinates relation to central axis 45. The specific dimensions of the respective surfaces of socket 34 are preferably determined by the following formulas.

$$\text{ACROSS CORNERS DIAMETER} = (\text{MINIMUM FLATS}) \times 1.1547'' + .004''$$

$$\text{MINOR DIAMETER} = \frac{(\text{MEAN FLATS})}{.966''}$$

$$Ax = .082'' \times \text{MINOR DIAMETER}$$

$$Ay = Ax \times \text{TAN } 19^\circ + \frac{\text{MINOR DIAMETER}}{2}$$

$$Bx = (.36'' \times Ax) + Ax$$

$$By = (Bx - Ax) + \text{TAN } 24^\circ + Ay$$

$$Cx = \frac{\text{CORNER DIAMETER}}{2} \times \text{SIN } 14^\circ$$

$$Cy = \frac{\text{CORNER DIAMETER}}{2} \times \text{COS } 14^\circ$$

In the aforementioned formulas, "MINIMUM FLATS" refers to the industry standard minimum dimension across the flats of a fastener, and "MEAN FLATS" refers to the standard mean or average dimension across the flats of a typical fastener. The length of engagement surface 40, 42 may be calculated using the above formulas and standard trigonometric functions. The length of such surfaces are substantially equal to 0.0867 x minor diameter of the fastener nut to be driven.

As heretofore described, the side-by-side angular related straight surfaces 40, 42 are disposed at substantially 142° (degree) outside obtuse angles to each other. This 142° (degree) angle (compared to the 150° angle found int he regular double hexagonal opening) provides improved contact between the engagement surfaces 40 and the fastener faces 22. Importantly, the position of engagement surfaces 40 takes into account the position of the wrench at engagement with the fastener during actual driving, which position depends upon the amount of clearance between the wrench and the fastener. More specifically, as the clearance is taken up in turning the wrench to engage the fastener, there is an angular displacement of the wrench relative to the fastener. Thus there is a need to selected an angle of engagement surface 40 which best matches that of fastener 20 at that specific position.

Figure 4:
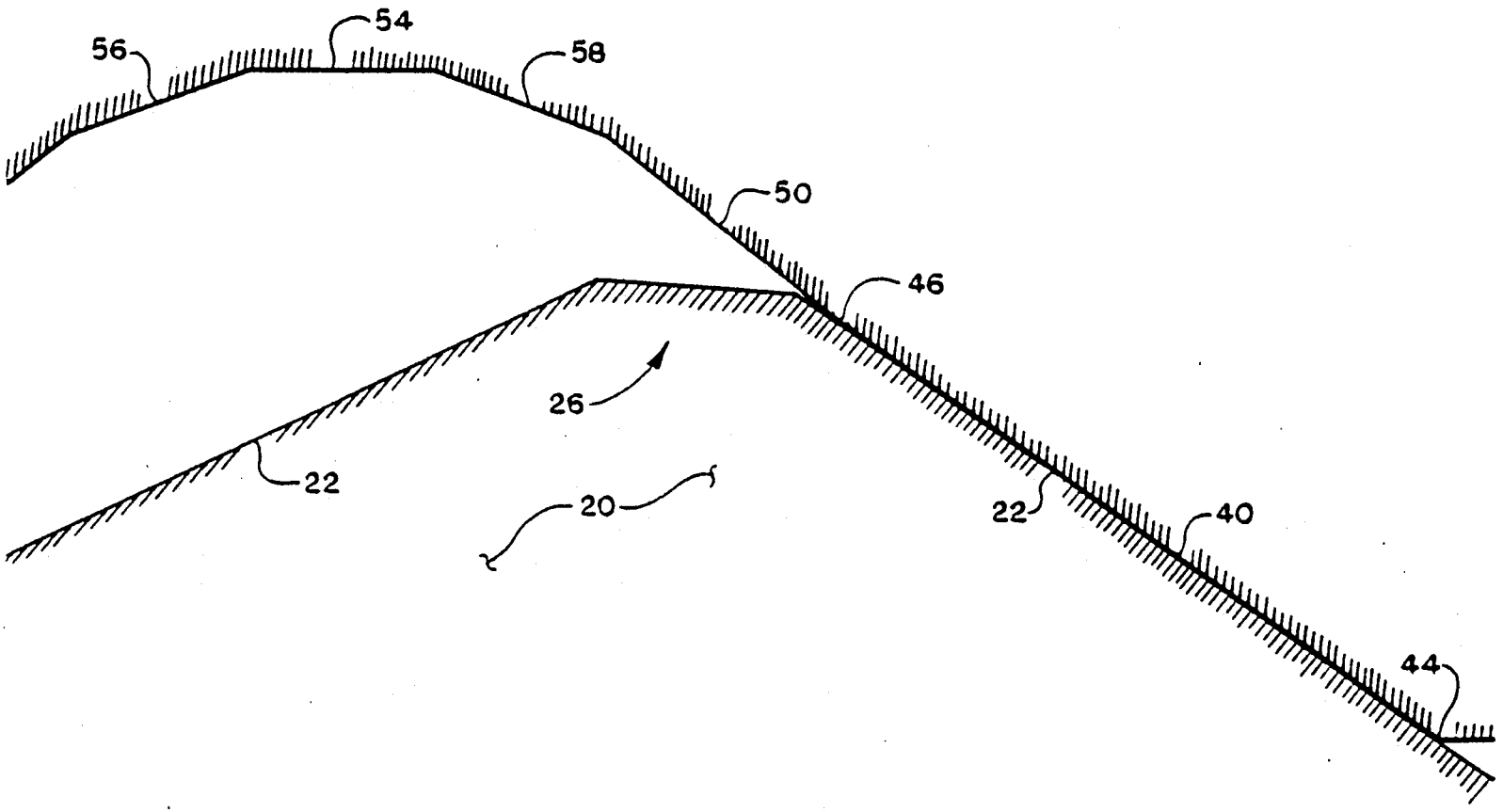
FIG. 4 is an enlarged view showing the typical surface contact between the engaging face of the socket shown in FIG. 1 and the flat portion of a hexagonal or double hexagonal fastener.

FIG. 4 illustrates the position of the respective surfaces of socket 34 and a minimum sized fastener 20. As can be seen, engagement surface 40 approximates the position of planar face 22 of the fastener 20. As can also be seen, edge 46 is located away from corner 26 of fastener 20. Thus, the present invention provides improved surface engagement between the socket and the fastener yet avoids contact with the corner 26 of fastener 20.

Figure 5:
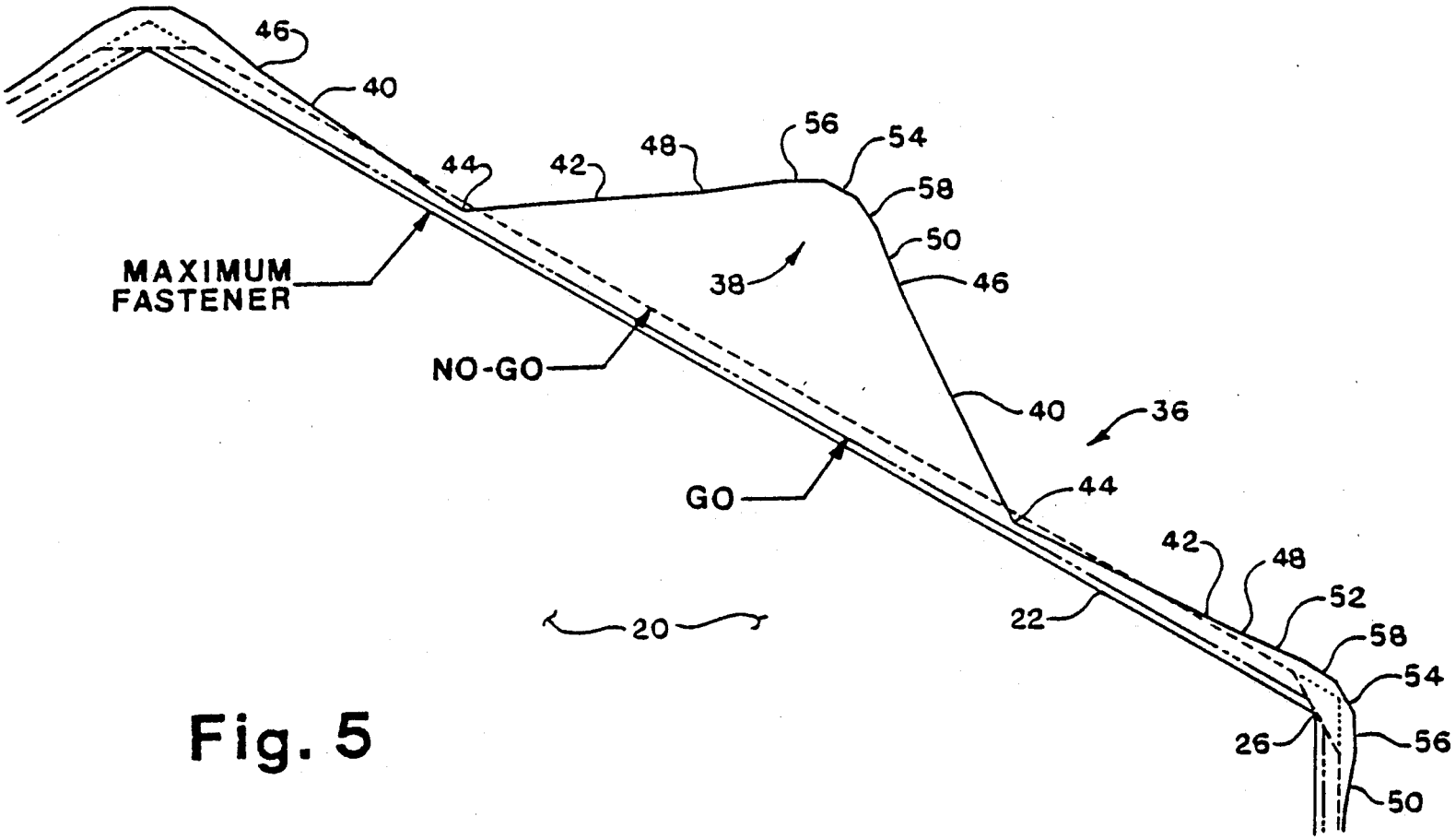
FIG. 5 is an enlarged view of the socket shown in FIG. 1 shown in relation to a maximum size standard fastener and socket-opening gauges.

FIG. 5 illustrates the relative position of socket opening 20 with respect to a maximum sized fastener, as well as to conventional GO and NO GO gauges shown in phantom. As set forth previously, such gauges are used to determine whether a given socket opening is within proper clearance standards. As also mentioned above, forging punches normally wear at the corners thus reducing the overall corner dimension. In this respect, in practice it has been known to use as large a punch as possible so as to give a reasonable amount of wear on the corners before they become undersized and the GO gauge no longer enters the socket opening. This results in a cross flats dimension being on the large size if the punch of a hexagonal design because the across the flats dimension is fixedly linked to the across the corners dimension. As seen in FIG. 5, a portion of the engagement surface 40 of socket 34 falls between the NO GO and GO gauges. In this respect, a forging punch for the disclosed socket opening starts with a closer tolerance in the fastener engaging area of the socket. Thus, as the forging punch beings to wear and the socket opening becomes smaller (the socket corner wears faster than the socket flanks or engaging faces), the increase in the area about eh fastener corner enables longer forging punch life without starting with a socket which is oversized in the driving area.

According to another aspect of the present invention, several of the advantages set forth about may also be incorporated in a six-sided socket as shown in FIGS. 6–8. Socket wrench 12 is comprised of a generally cylindrical body 61 which is provided at one end with a substantially square socket 63 (best seen in FIG. 6) for reception of the operating stem of a suitable socket wrench, a motor driven spindle or other actuating member (not shown). The other end of the cylindrical body 61 is provided with a work receiving cavity 80 which is symmetrical about an axis 65, which in FIG. 6 is coincident with axis 67 of fastener 20. Cavity 80 is comprised of an even-numbered plurality of uniformly spaced peripherally and radially disposed protuberances 60 having an equal number of nut corner clearance recesses 62 disposed therebetween. (As used hereinafter, inward or inner shall designate a direction toward the central axis 65 of socket 12, and outward or outer shall designate a direction away from axis 65.)

In the embodiment shown, socket 12 includes six (6) protuberances 60 and six (6) corner recesses 62. In FIG. 8, an enlarged portion of the socket 12 according to the present invention is shown in relation to axes designated "X" and "Y" which are normal to each other and intersect at central axis 65 of the socket. Each protuberance 60 is comprised of three (3) drive surfaces, namely engaging surfaces 64, 66 and connecting surface 68. Engaging surfaces 64, 66 diverge outwardly from connecting surface 68 at inner edges 82, 84. Engaging surfaces 64, 66 are disposed at a substantially 176° (degree) outside obtuse angle to each other. Connecting surface 68 is in registry with the planar faces or flanks 22 or fastener 20. Engaging surfaces 64,66 have identical predetermined lengths which terminate at outer edges 70, 72 respectively.

Nut corner clearance recesses 62 are comprised of an arcuate surface 78, and transitional surfaces 74, 76. Transitional surfaces 74, 76 diverge inwardly from arcuate surface 78 and communicate with respective engaging surfaces 64, 66 of adjacent protuberances 60 at outer edges 70, 72. Arcuate surface 78 is defined by a circle about socket axis 65. Preferably, arcuate surface 78 and transitional surfaces 74, 76 approximate a circular arc connecting engaging surfaces 64, 66 of adjacent protuberances 60. To minimize stress concentrations at the corners defined by the respective surfaces, it is also preferable that the angle defined between arcuate surface 78 and adjacent transitional surfaces 74, 76 be approximately equal to the angle defined between an engaging surface 64, 66 and respective transitional surfaces 74, 76. In this respect, by equalizing these angles, the stress concentrations resulting from such corners are minimized and distributed, to the extent possible, along the entire corner recess 62.

As with the twelve-sided socket previously described, the six-sided embodiment of the present invention provides a corner recess design which is easy to manufacture, yet approximates the optimum design of a fully rounded corner. As set forth above in the discussion of the twelve-sided socket, a truly rounded corner recess is not actually possible due to manufacturing limitations in creating the forging punches used to manufacture the sockets. Cutting machines which cut the forging punch make a number of successive passes along the punch-cutting flat surfaces which together approximate a curve. Such cutting machines inevitably leave "steps" between the successive passes. Because socket cavity 80 is comprised essentially of flat surfaces, greater dimensional accuracy is provided when manufacturing the forging punches used to form the socket opening 80. As will be appreciated, arcuate surface 78, which is disposed on the periphery of the forging punch may be machined by a lathe thereby insuring dimensional accuracy.

The length and orientation of the planar surfaces defining socket cavity 80 is determined by the size of the fastener nut 20 to be turned as well as certain design criteria. In this respect, these planar surfaces are dimensioned to minimize stress concentrations by avoiding sharp arcuate angles such as at the corner recesses 62 and to provide a more parallel engagement between engaging surfaces 64, 66 and fastener faces 22. As shown in FIG. 8, the shape of the socket opening 80 may be defined with reference to X-Y coordinates in relation to central axis 65. The specific dimensions of the respective surfaces of socket 80 are preferably determined by the following formulas.

ACROSS CORNERS DIAMETER =

(MINIMUM FLATS) × 1.1547" + .004"(CORNER FACTOR)

$$Ay = (\text{MEAN FLATS})$$
$$Ax = Ay/2 \times \text{TAN } 12°$$
$$Bx = 2.477\ ax$$
$$By = Ay/2 + [(Bx - Ax) \times \text{TAN } 2°]$$
$$Cx = \text{CORNERS DIAMETER} \times \text{SIN } 29°$$
$$Cy = \text{CORNERS DIAMETER} \times \text{COS } 29°$$

In the aforementioned formulas, "MINIMUM FLATS" refers to the industry standard minimum dimension across the flats of the gage and "MEAN FLATS" refers to the average dimension the flats of the maximum and minimum gage. The length of engaging surfaces 64, 66 may be calculated using the above formulas and standard trigonometric functions.

As heretofore described, the angularly related engaging surfaces 64, 66 are disposed at a substantially 176° (degrees) outside obtuse angle to each other. This 176° (degree) angle (compared to the 180° angle found in the regular hexagonal opening) provides improved contact between the engaging surfaces 64, 66 and the fastener face 22. Importantly, the position of the engaging surfaces 64, 66 takes into account the position of the wrench in engagement with the fastener during actual driving, which position depends upon the amount of clearance between the wrench and the fastener. FIG. 7 illustrates the position of the respective surfaces of socket opening 80 and a minimum sized fastener 20. With respect to the clearance between the socket and the fastener, the angular play created by such clearance can be reduced by increasing (flattening) the outside angle between engaging surfaces 64, 66 and by increasing the connecting surface 68 (thereby reducing the length of the engaging surfaces). In this respect, by flattening (increasing) the outside obtuse angel between surfaces 64, 66 to 178° and increasing the connecting surfaces to a length greater than 0.2125 times (×) the mean flats of the fastener nut to be driven (which shortens the engaging surfaces), the angular play is reduced. Importantly, such changes still maintain the additional across and corners dimension of the previously discussed sockets. This provides a little more width on the points of the punch so as to reduce the wear of the forging punch, yet still maintains the corner recess design described above.

As previously mentioned, forging punches normally wear at the corners thus reducing the overall corner dimension. In this respect, in practice it has been known to use as large a punch as possible so as to give a reasonable amount of were on the corners before they become undersized and the GO gage no longer enters the socket opening. This results in a cross flats dimension being on the large size of the punch of a hexagonal design because the across the flats dimension is fixedly linked to the across the corners dimension. In this respect, a forging punch for the disclosed socket openings start with a closer tolerance in the fastener engaging area of the socket. Thus, as the forging punch begins to wear and the socket openings become smaller (the socket corners wear faster than the socket flanks or engaging faces), the increase in the area about the fastener corner enables longer forging punch life without starting with sockets which are oversized in the driving area.

Thus, the present invention provides socket opening designs which increases the driving surface area of the sockets which in turn minimizes and more uniformly distributes the internal stress therealong. At the same time, one embodiment of a socket according to the present invention avoids contact with the fastener corner which produces high stress concentrations. In addition, the present invention provides socket designs wherein the corner clearance recesses avoid sharp arcuate surfaces by providing a generally rounded corner further reducing stress concentration. Still further, the present invention provides socket designs comprised primarily of planar surfaces which facilitate the design and manufacture of forging punches necessary to fabricate the sockets. As set forth above, the present invention provides a design wherein the angles between adjacent engagement surfaces provides better mating between such engagement surfaces and the flats of the fastener. This also provides less clearance with respect to the sockets by positioning a portion of the driving surface between the typical GO and NO GO gauges.

The present invention has been described with respect to preferred embodiments. Modifications and alterations will occur to others upon the reading and understanding of this specification. It is intended that all such modifications and alterations be included insofar as they come within the scope of the patent as claimed or the equivalence thereof.

Having thus described the invention, the following is claimed:

1. A wrench for turning a fastener nut having a central axis and an even-numbered plurality of flat bounding surfaces parallel to said central axis with diametrically opposite pairs being parallel to each other wherein said bounding surfaces intersect in adjacent pairs to form fastener corners, said wrench having a fastener nut engaging socket defined about a central socket axis, said fastener nut engaging socket defined by a plurality of uniformly spaced peripherally and radially disposed protuberances and a plurality of uniformly spaced corner recesses disposed between said protuberances, each protuberance including a straight connecting surface and complimentary straight engaging surfaces diverging at least 2° outwardly from said connection surface at a point disposed at an angle of about 12° on either side of a radial line extending from said central socket axis and bisecting said connecting surface, said engaging surfaces being at about a 176° outside obtuse angle to each other for registry with said flat bounding surfaces on said fastener nut, said connecting surfaces having a length substantially equal to 0.21256 times (×) the mean flats of the fastener nut to be driven, each corner recess comprised of an arcuate surface defined by a circle about said central axis of said socket and transitional surfaces converging from said engaging surfaces of adjacent protuberances inwardly toward said arcuate surface.

2. A wrench as defined in claim 1 wherein said engaging surfaces diverge from said connecting surface at a 2° angle.

3. A wrench as defined in claim 1 wherein said arcuate surface and said transitional surfaces of said corner recess approximate an inscribed arc of a circle connecting the diverging surfaces of said adjacent protuberances.

4. A wrench as defined in claim 1 wherein said engaging surfaces are at substantially 176° outside obtuse angles to each other.

5. A wrench as defined in claim 1 wherein said engaging surfaces diverge from said connecting surface at a point disposed at an angle of 12° on either side of a radial line extending from said central socket axis and bisecting said connecting surface.

6. A wrench for turning a fastener nut having a central axis and an even-numbered plurality of flat bounding surfaces parallel to said central axis with diametrically opposite pairs being parallel to each other wherein said bounding surfaces intersect in adjacent pairs to form fastener corners, said wrench having a fastener nut engaging socket defined about a central socket axis, said fastener nut engaging socket defined by a plurality of uniformly spaced peripherally and radially disposed protuberances and a plurality of uniformly spaced corner recesses disposed between said protuberances, each protuberance including a straight connecting surface and complimentary straight engaging surfaces, said engaging surfaces being 176° and 178° outside obtuse angle to each other, said connecting surfaces having a length greater than 0.21256 times (×) the mean flats of the fastener nut to be driven, each corner recess comprised of an arcuate surface defined by a circle about said central axis of said socket and transitional surfaces converging from said engaging surfaces of adjacent protuberances inwardly toward said arcuate surface, said arcuate surface and said transitional surfaces being dimensioned such that the angle defined between a transition surface and an adjacent surface approximate the angle defined between said transitional surface and said arcuate surface, wherein said arcuate surface and said transitional surface adjacent thereto approximate a circular arc connecting the engaging surfaces of the adjacent protuberances.

7. A wrench as defined in claim 6 wherein said straight engaging surfaces are at substantially 176° outside obtuse angles to each other.

8. A wrench as defined in claim 6 wherein said straight engaging surfaces diverge at least 2° outwardly from said connecting surface at a point disposed at an angle of about 12° on either side of a radial line extending from said central socket axis and bisecting said connecting surface.

* * * * *

UNITED STATES PATENT AND TRADEMARK OFFICE

CERTIFICATE OF CORRECTION

PATENT NO. : 5,012,706

DATED : May 7, 1991

INVENTOR(S) : Richard B. Wright

It is certified that error appears in the above-identified patent and that said Letters Patent is hereby corrected as shown below:

Add the drawing sheets, consisting of Figs. 6, 7 and 8 as shown on the attached pages.

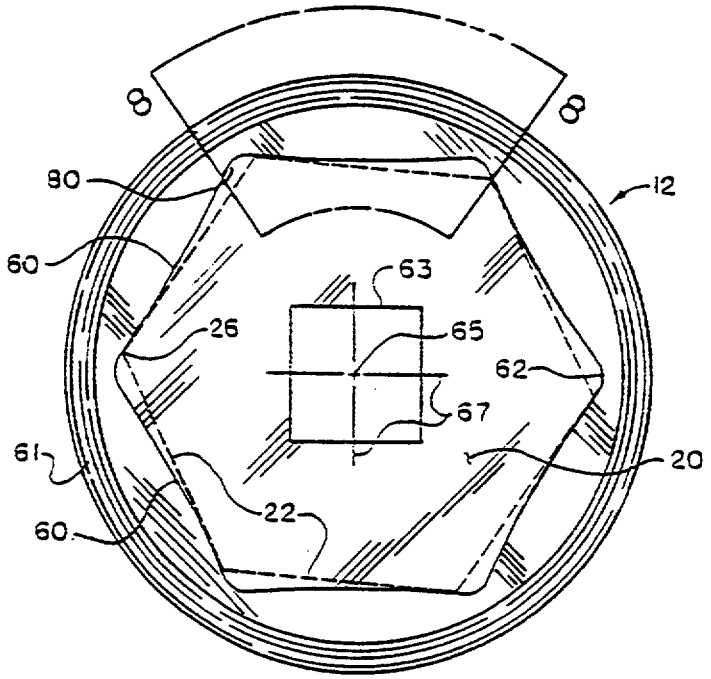

FIG. 6

UNITED STATES PATENT AND TRADEMARK OFFICE

CERTIFICATE OF CORRECTION

PATENT NO. : 5,012,706

DATED : May 7, 1991

INVENTOR(S) : Richard B. Wright

It is certified that error appears in the above-identified patent and that said Letters Patent is hereby corrected as shown below:

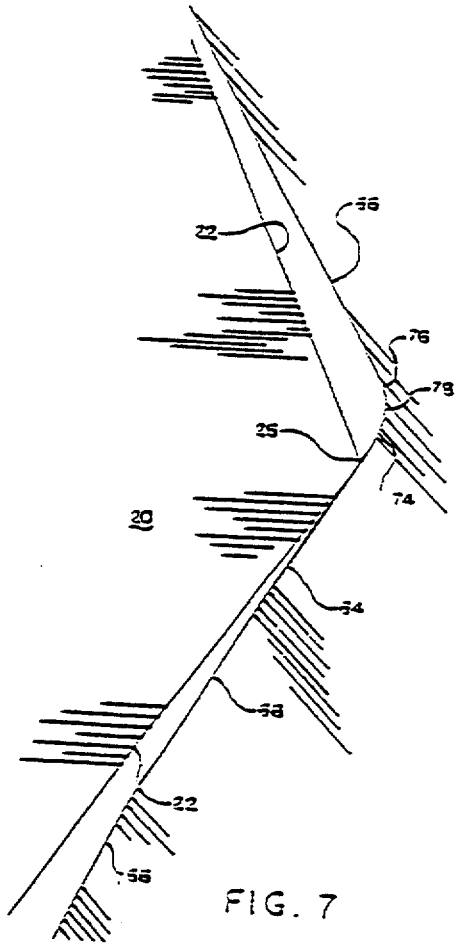

FIG. 7

UNITED STATES PATENT AND TRADEMARK OFFICE

CERTIFICATE OF CORRECTION

PATENT NO. : 5,012,706

DATED : May 7, 1991

INVENTOR(S) : Richard B. Wright

It is certified that error appears in the above-identified patent and that said Letters Patent is hereby corrected as shown below:

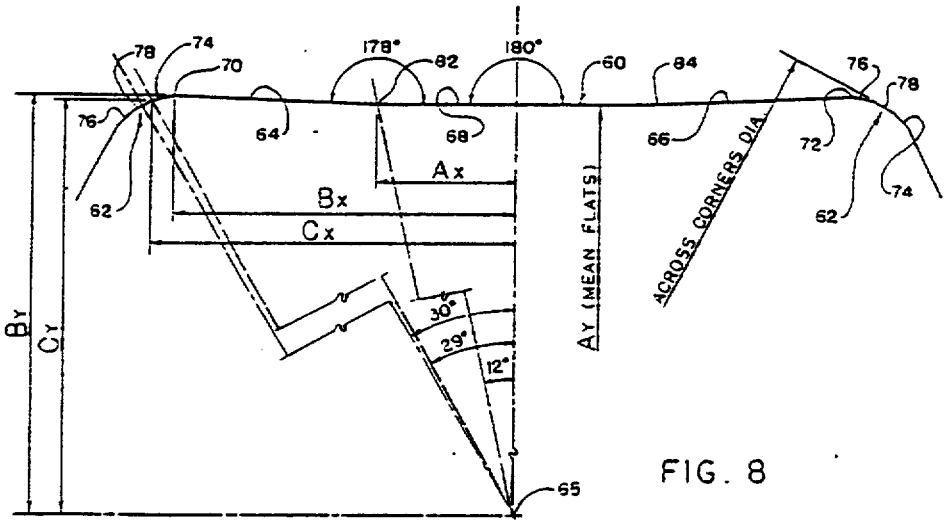

FIG. 8

Signed and Sealed this

Twelfth Day of September, 1995

*Attest:*

*Attesting Officer*

BRUCE LEHMAN

*Commissioner of Patents and Trademarks*